US006325426B1

(12) United States Patent
Boesl

(10) Patent No.: US 6,325,426 B1
(45) Date of Patent: Dec. 4, 2001

(54) DEVICE AND METHOD FOR TYING INFLATED PARTY BALLOONS

(76) Inventor: Samantha Boesl, 4742 42$^{nd}$ Ave. SW. Box 413, Seattle, WA (US) 98116

( * ) Notice: Subject to any disclaimer, the term of this patent is extended or adjusted under 35 U.S.C. 154(b) by 0 days.

(21) Appl. No.: 09/596,175

(22) Filed: Jun. 16, 2000

(51) Int. Cl.$^{7}$ ..... B65H 69/04

(52) U.S. Cl. ..... 289/1.5; 289/2; 289/17; 289/18.1

(58) Field of Search ..... 289/1.2, 1.5, 2, 289/3, 4, 13, 14, 17, 18.1

(56) References Cited

U.S. PATENT DOCUMENTS 4,510,653 * 4/1985 Semanko ..... 289/1.5
4,989,906 * 2/1991 Peverley ..... 289/17
5,039,142 * 8/1991 Muma ..... 289/17
5,098,137 * 3/1992 Wardall ..... 289/17
5,104,160 * 4/1992 Cheng ..... 289/17
5,314,217 * 5/1994 Place ..... 289/17
5,568,950 * 10/1996 Herren ..... 289/17
5,611,578 * 3/1997 Angelico, Sr. et al. ..... 289/17
5,882,051 * 3/1999 Dreger et al. ..... 289/17
6,082,785 * 7/2000 Morgan et al. ..... 289/17

* cited by examiner

*Primary Examiner*—John J. Calvert
*Assistant Examiner*—Gary L. Welch
(74) *Attorney, Agent, or Firm*—Ratner & Prestia

(57) ABSTRACT

A device and method for tying a knot in the inflation end of an inflated balloon using a generally key hole shaped aperture in a rigid surface having a radius of curvature. The inflation end of the balloon can be wound around the device with the key hole shaped aperture adapted to secure the extreme inflation end of the balloon so that the portion wrapped around the device can be rolled off the device to effect tying of the knot.

14 Claims, 4 Drawing Sheets

DEVICE AND METHOD FOR TYING INFLATED PARTY BALLOONS

BACKGROUND OF THE INVENTION

The present invention pertains to tying the end of an inflated party balloon so that the inflating medium (e.g. air, helium etc.) will not escape from the tied end of the balloon.

Numerous methods have been used to tie the ends of party balloons filled with air, helium or other inflating gases, so that the balloons maintain their shape and can be used either singularly or in groups to form patterns or clusters or even balloon sculptures. One method is to use a length of string to tie the end of the balloon after it is inflated so that the balloon maintains it shape.

A device that slips over the finger has been marketed for aiding a user in tying the end of a filled balloon. Such devices are available from Unique Industries Inc. of Philadelphia, Pa.

As anyone who has been involved with inflating balloons for parties, other indoor or outdoor activities, family gatherings and the like knows it is a chore to tie the end of an inflated balloon into which the inflating medium has been introduced when just using the balloon material itself. Therefore, there is a need for a device and method that will provide a user with the ability to securely tie the end of an inflated party balloon.

SUMMARY OF THE INVENTION

The present invention is a device in the nature of a rigid surface having a radius of curvature the device having a keyhole shaped aperture extending from one edge of the device. The device is sized so that the end of the balloon used to introduce inflating medium can be wrapped around the device and the distal portion of the filling end placed into the keyhole so that a simple sliding of the wrapped portion of the balloon over the keyhole shaped opening and off of the device produces a securely tied end of the inflated balloon.

Thus, in one aspect the present invention is a device for tying a knot in a gaseous fluid filled balloon like device having a neck like filling portion, comprising in combination; a rigid surface having a radius of curvature, the rigid surface having a length greater than about one-half inch; the surface having the general shape of a portion of a cylinder; at least one slot extending from an edge of the surface of the device perpendicular to the radius of curvature of the surface toward an opposite edge of the rigid surface; and a generally circular aperture in the surface, the circular aperture having a vertical central axis generally parallel to the radius of curvature of the rigid surface, the aperture and the slot forming a primary generally key-hole shaped opening in the rigid surface.

In another aspect the present invention is a device for tying inflated balloons comprising in combination; a generally cylindrical body having a first end and a second end; at least one slot in a wall of the body, the slot extending from the first end toward the second end of the body, and a generally circular shaped aperture communicating with the slot to form a generally key-hole shaped opening in the wall of the body.

In yet another aspect of the present invention is a method for rapidly tying inflated balloon comprising the steps of; providing a device having a generally cylindrical body having a first end and a second end; at least one slot in a wall of the body the slot extending from the first end toward the second end of the body, and a generally circular shaped aperture communicating with the slot to form a generally key-hole shaped opening in the wall of the body, elongating a filling end of the balloon, placing the elongated filling end over the slot in the device, wrapping the elongated end of the balloon around the body of the device and over the portion of the balloon placed over the slot in the device, placing the extreme end of the elongated end of the balloon in the slot in the device, and rolling the wrapped portion of the filling end of the balloon in a direction toward and over the extreme end portion of the balloon to form a knot in the filling end of the balloon.

DETAILED DESCRIPTION OF THE INVENTION

Figure 1:
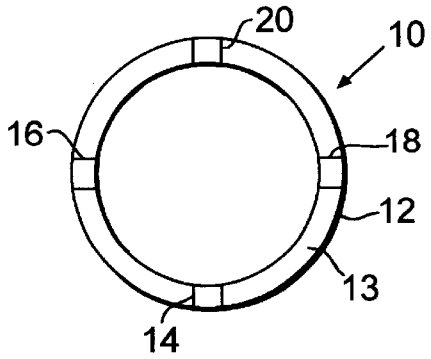
FIG. 1 is a top plan view of the device of the present invention.
Figure 2:
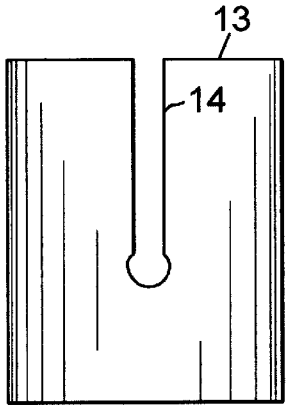
FIG. 2 is a front elevation view of the device of FIG. 1.
Figure 3:
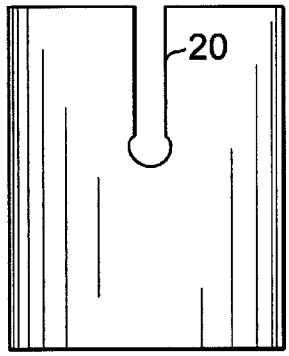
FIG. 3 is a rear elevation view of the device of FIG. 1.
Figure 4:
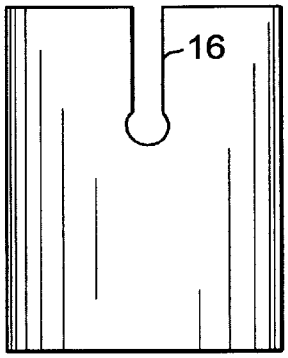
FIG. 4 is a left side elevation view of the device of FIG. 1.
Figure 5:
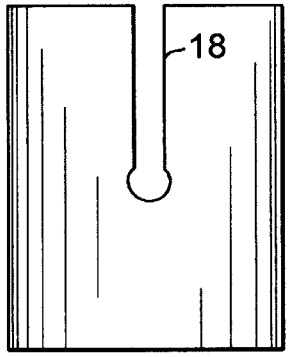
FIG. 5 is a right side elevation view of the device of FIG. 1.

Referring to FIGS. 1 through 5 the device of the present invention is, in a preferred embodiment, a rigid wall cylinder shown generally as 10. The rigid wall cylinder 10 can be a short length of pipe, e.g. PVC pipe 12 containing as shown in FIG. 2, at least one keyhole shaped aperture 14. Keyhole shaped aperture extends from a top surface 13 toward a bottom surface of the cylinder 10. As shown in FIGS. 3–5, second, third and fourth keyhole apertures 16, 18 and 20 can be spaced equally around the circumference of the cylinder 10. The second, third and fourth keyhole shaped apertures 16, 18, 20 are not as long as the primary keyhole aperture 14, the function of which will be explained hereinafter.

Figure 6:
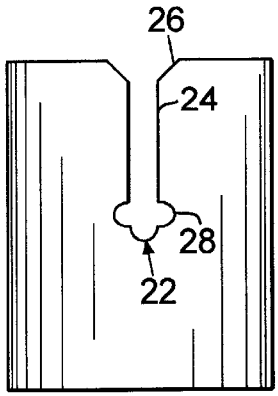
FIG. 6 is a front elevation view of an alternate embodiment of the device of the present invention.

FIG. 6 is a front elevation view of an alternate embodiment of the present invention showing a slotted portion 24 of an aperture 22. The aperture 22 has a chamfered top portion 26 and a plurality of semi-circular openings 28 at the bottom of the slot portion 24. The function of the alternate embodiment will be explained in more detail in relation to tying a balloon.

Figure 7:
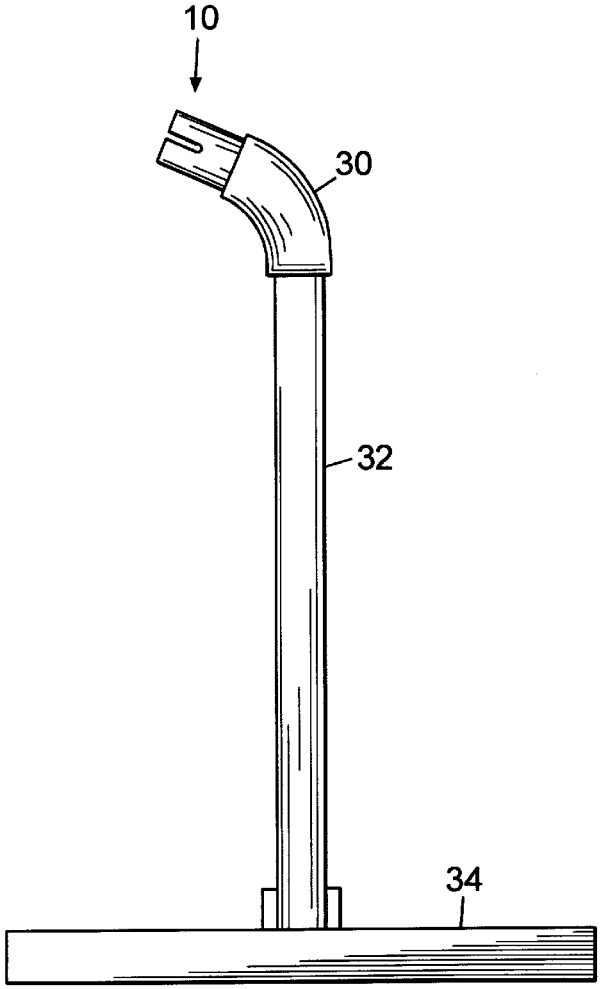
FIG. 7 is a front elevation view of one method of supporting a device of the present invention so a user can have both hands free to tie the balloon.

FIG. 7 shows a device 10, which is mounted in a 45° elbow 30 which in turn is mounted on a vertical pipe or conduit 32, which can be placed in a suitable stand 34 so that the user can have both hands free to tie balloons and the like as will be hereinafter more fully explained. The device of FIG. 7 can be used without the stand so that the vertical pipe 32 could be fastened directly to a cylinder of air or helium used to inflate party balloons.

Figure 8:
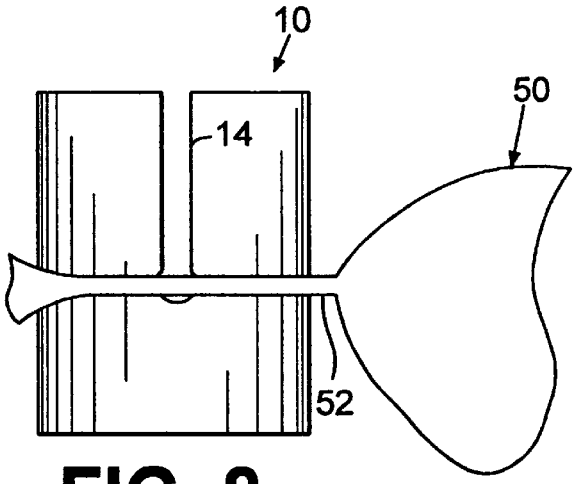
FIG. 8 is a front elevation view showing the first step in tying a balloon according to the present invention.
Figure 9:
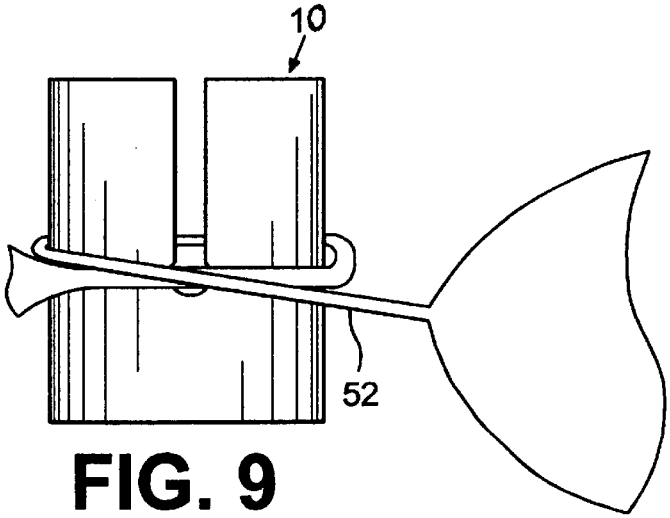
FIG. 9 is a front elevation view showing a second step in tying a balloon according to the present invention.
Figure 10:
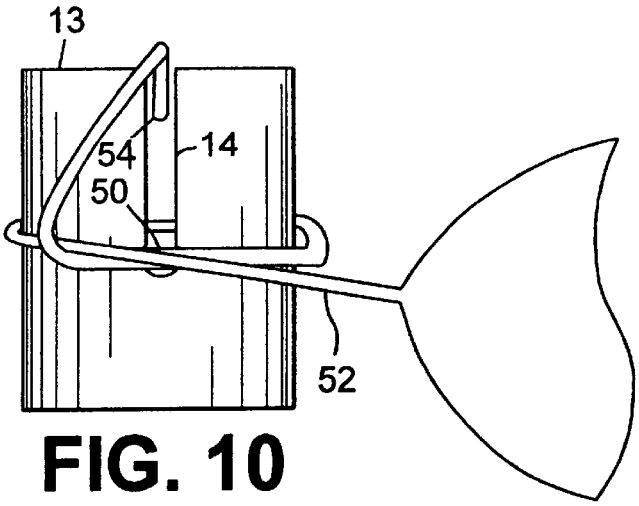
FIG. 10 is a front elevation view showing a third step in tying a balloon according to the present invention.

Referring to FIG. 8, an inflated balloon 50 has the un-inflated end portion 52 stretched out and wrapped over the circular portion of the keyhole shape aperture 14 of the device as shown in FIG. 2. The extreme rolled or distal end 54 of portion 52 of balloon 50 can be held by the users thumb against the cylindrical portion of the device 10. FIG. 9 shows a second step wherein the un-inflated portion 52 of the balloon 50 is stretched and wrapped around the device 10 so that it overlaps the portion shown in FIG. 8. FIG. 10 shows the step wherein the extreme or distal end 54 of the balloon 50 is stretched and inserted into the circular portion of the keyhole aperture 14. Thereafter, all the user has to do is roll the portion of the balloon 50 wrapped around the device 10 toward the end 13 of device 10 to complete a secure knot in the filling or uninflated portion of the balloon.

Figure 11:
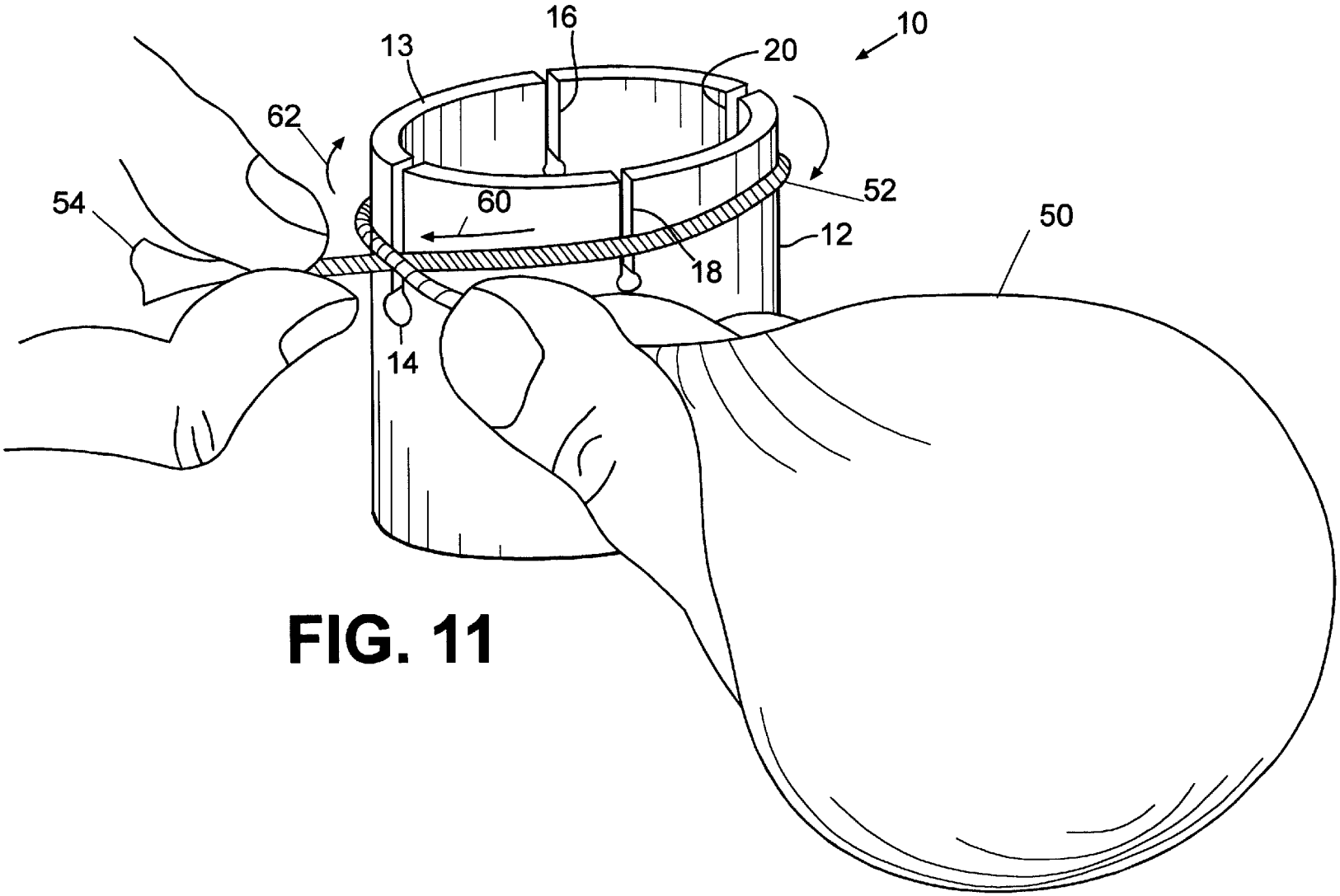
FIG. 11 is a perspective view showing a portion of a users hands between the second and third steps of tying a balloon viewed according to the present invention.

FIG. 11 shows the extreme or distal end 54 balloon 50 being held by one hand of a user that has been overlapped by the rear end of the stretched portion 52 of balloon 50 which is wrapped in the direction shown by arrow 60. Thereafter the extreme end 54 of balloon 50 is inserted into keyhole shaped aperture 14 by movement in accordance with directional arrow 62. Thereafter the user rolls the wrapped portion 52 of balloon 50 toward end 13 of device 10 to complete a knot in the balloon.

If a user wishes to take a number of inflated balloons and tie them to a nest or bouquet of balloons, individual balloons can be placed in the circular portion of apertures 16, 18, 20, with aperture 14 used to tie the last balloon. Since aperture 14 is longer than apertures 16, 18 and 20 as the end of the last balloon is rolled toward the end 13 of device 10 the balloons in the other apertures will be tied securely to the last balloon.

In a like matter the user can place ribbon or string or other devices sought to attached to a balloon into any of the secondary apertures 16, 18 and 20 and the anchoring balloon tied using aperture 14.

The device 10 can be made from various materials, PVC pipe and tubing being readily available and easily worked into the required shapes. It has been found that the circular aperture portion of the keyhole shaped apertures can be approximately one quarter inch in diameter. The connecting slots should be approximately three-sixteenth inches in width. The size of the circular apertures and width of the slots can vary to accommodate balloons of various wall thickness.

The embodiment of FIG. 6 permits secondary or tertiary balloons to be put into the side apertures in the generally clover leaf portion 28 of aperture 22 and the bottom portion of the clover leaf used to tie the last balloon. The chamfered surface 26 facilitates inserting the distal end of the last balloon or the previously tied balloons into the device.

It has been shown that balloons tied with the method and apparatus of the invention have secure knots that are not easily opened by children. These balloons filled with helium using the method and apparatus of the invention will make it more difficult for children to access the helium.

Having thus described my invention as illustrated and described herein with reference to certain specific embodiments, the present invention is nevertheless not intended to be limited to the details shown. Further, various modifications may be made in the details within the scope of the invention desired to be secured by Letters Patent of the United States as set forth in the appended claims.

What is claimed:

1. A device for tying a knot in a gaseous fluid filled balloon like device having a neck like filling portion comprising in combination:

a rigid cylindrical hollow body having a length greater than about one-half inch, said body having a wall portion and a first end and a second end;

at least one slot extending from an end of said body perpendicular to a radius of curvature of said body toward said second end of said body, said slot extending through said wall portion along its entire length; and a generally circular aperture extending through said wall portion, said circular aperture having a vertical axis generally parallel to said radius of curvature of said wall portion of said body, said aperture and said slot forming a primary generally key-hole shaped opening through said wall of said body.

2. A device according to claim 1, including a second generally key-hole shaped opening spaced laterally from said primary key-hole shaped opening.

3. A device according to claim 2, including a third generally key-hole shaped opening spaced laterally from said primary key-hole shaped opening, said third generally key-hole shaped opening placed on an opposite side of said primary key-hole shaped opening from said second key-hole shaped opening.

4. A device according to claim 3, wherein said second and third key-hole shaped openings are of a total length shorter than the length of said primary key-hole shaped opening.

5. A device for tying inflated balloons comprising in combination;

a generally cylindrical hollow body having a first end and a second end;

a first slot in a wall of said body, said slot extending from said first end toward said second end of said body;

a generally circular shaped aperture communicating with said slot to form a primary generally key-hole shaped opening in said wall of said body; a second generally key-hole shaped opening spaced laterally from said primary key-hole shaped opening and a third generally key-hole shaped opening spaced laterally from said primary key-hole shaped opening, said third generally key-hole shaped opening placed on an opposite side of said primary key-hole shaped opening from said second key-hole shaped opening and a fourth generally key-hole shaped opening spaced laterally from said primary key-hole shaped opening, said fourth generally key-hole shaped opening placed on an opposite side of said of said body from said primary key-hole shaped opening.

6. A device according to claim 5, wherein said four generally key-hole shaped openings are spaced equally around the circumference of said cylindrical body.

7. A method for rapidly tying an inflated balloon comprising the steps of: (a) providing a device having a generally cylindrical hollow body having a first end and a second end with at least one slot in a wall of said body, said slot extending from said first end toward said second end of said body, and a generally circular shaped aperture communicating with the slot to form a generally key-hole shaped opening in and extending through said wall of said body; (b) elongating a filling end of said balloon; (c) placing the elongated filling end over said slot in said device; (d) wrapping the elongated end of said balloon around said body of said device and over said elongated portion of said balloon placed over said slot in said device; (e) placing said extreme end of said elongated end of said balloon in said slot in said device, and (f) rolling said wrapped portion of said filling end of said balloon in a direction toward and over the extreme end portion of the balloon to form a knot in the filling end of the balloon.

8. A method according to claim 7, further including the step of: placing three additional key hole shaped apertures extending through said wall of said body around the circumference of said device each of said additional key-hole shaped apertures extending for a different length with said first aperture being longer than any of said additional apertures.

9. A method according to claim 8, further including the step of: placing at least one previously tied balloon in one of said additional key hole shaped apertures before tying a balloon in order to tie said balloons together.

10. A method according to claim 8, further including the step of: placing one of a tied balloon, length of ribbon, length of string or combinations thereof in one or more of said additional key hole shaped apertures.

11. A method according to claim 7, further including the step of: placing an item being, one of a tied balloon, length of ribbon, length of string, or combinations thereof in said generally circular shaped aperture prior to tying a balloon using said key-hole shaped aperture to tie said item in said circular aperture to a balloon being tied.

12. A method for rapidly tying an inflated balloon comprising the steps of: (a) providing a device having a generally cylindrical hollow body having a first end and a second end with a first slot in a wall of said body, said first slot extending from said first end toward said second end of said body, and a generally circular shaped aperture communicating with the slot to form a generally key hole shaped opening in said wall of said body; placing three additional key-hole shaped apertures around the circumference of said device; placing at least one previously tied balloon in one of said additional key-hole shaped apertures; (b) elongating a filling end of said balloon; (c) placing the elongated filling end over said first slot in said device; (d) wrapping the elongated end of said balloon around said body of said device and over said elongated portion of said balloon placed over said first slot in said device; (e) placing said extreme end of said elongated end of said balloon in said first slot in said device, and (f) rolling said wrapped portion of said filling end of said balloon in a direction toward and over the extreme end portion of the balloon to form a knot in the filling end of the balloon.

13. A method for rapidly tying an inflated balloon comprising the steps of: (a) providing a device having a generally cylindrical hollow body having a first end and a second end with a first slot in a wall of said body, said first slot extending from said first end toward said second end of said body, and a generally circular shaped aperture communicating with the slot to form a generally key hole shaped opening in said wall of said body; placing three additional key-hole shaped apertures around the circumference of said device; placing one of a tied balloon, length of ribbon, length of string or combination thereof in one or more of said additional key-hole shaped apertures; (b) elongating a filling end of said balloon; (c) placing the elongated filling end over said first slot in said device; (d) wrapping the elongated end of said balloon around said body of said device and over said elongated portion of said balloon placed over said first slot in said device; (e) placing said extreme end of said elongated end of said balloon in said first slot in said device, and (f) rolling said wrapped portion of said filling end of said balloon in a direction toward and over the extreme end portion of the balloon to form a knot in the filling end of the balloon.

14. A method for rapidly tying an inflated balloon comprising the steps of: (a) providing a device having a generally cylindrical hollow body having a first end and a second end with at least one slot in a wall of said body, said slot extending from said first end toward said second end of said body, and a generally circular shaped aperture communicating with the slot to form a generally key hole shaped opening in said wall of said body; placing an item being one of a tied balloon, length of ribbon, length of string, or combination thereof in said generally circular shaped aperture; (b) elongating a filling end of said balloon; (c) placing the elongated filling end over said slot in said device; (d) wrapping the elongated end of said balloon around said body of said device and over said elongated portion of said balloon placed over said slot in said device; (e) placing said extreme end of said elongated end of said balloon in said slot in said device, and (f) rolling said wrapped portion of said filling end of said balloon in a direction toward and over the extreme end portion of the balloon to form a knot in the filling end of the balloon.

* * * * *